US005873318A

United States Patent [19]

Bohlinger et al.

[11] Patent Number: 5,873,318

[45] Date of Patent: Feb. 23, 1999

[54] METHOD AND APPARATUS FOR SEWING A PLURALITY OF TRIM PIECES TOGETHER

[75] Inventors: Raymond Bohlinger, Sterling Heights; Steve S. Hurite, Southfield, both of Mich.

[73] Assignee: Lear Corporation, Southfield, Mich.

[21] Appl. No.: 775,393

[22] Filed: Dec. 31, 1996

[51] Int. Cl.[6] ..... D05B 23/00; A47C 7/02

[52] U.S. Cl. ..... 112/475.08; 112/475.13; 112/470.27; 112/320; 112/324; 112/302; 112/429; 297/452.38

[58] Field of Search ..... 112/475.08, 475.01, 112/470.27, 139, 153, 235, 236, 320, 302, 324, 323, 438, 415, 439, 430, 432, 434; 297/DIG. 1, DIG. 2, 452.57, 452.58, 452.27, 452.38; 156/156, 93

[56] References Cited

U.S. PATENT DOCUMENTS

| | | | |
|---|---|---|---|
| 842,184 | 1/1907 | Dowdall | 112/430 |
| 1,764,531 | 6/1930 | Schmid | 112/432 |
| 3,776,157 | 12/1973 | Szostak | 112/162 |
| 4,021,004 | 5/1977 | Poteat . | |
| 4,138,283 | 2/1979 | Hanusa | 156/77 |
| 4,319,532 | 3/1982 | Fogarty et al. . | |
| 4,404,921 | 9/1983 | Kastrup et al. | 112/296 X |
| 4,554,715 | 11/1985 | Reim et al. . | |
| 4,807,303 | 2/1989 | Mann et al. . | |
| 5,209,172 | 5/1993 | Kawaguchi et al. | 112/320 |
| 5,382,398 | 1/1995 | Dralmaier, Jr. | 112/470.27 X |
| 5,383,414 | 1/1995 | Winter et al. | 112/162 |
| 5,490,890 | 2/1996 | Morrison . | |

*Primary Examiner*—Ismael Izaguirre

*Attorney, Agent, or Firm*—MacMillan, Sobanski & Todd, LLC

[57] ABSTRACT

An automotive seat assembly comprising a multitude of trim pieces sewn together along their respective edge portions. A continuous first stitching material passes through and between a number of apertures along a trim piece to form a first seam. A continuous second stitching material passes through and between a number of apertures along another trim piece to form a second seam. The first stitching material loops around the second stitching material between the trim pieces to secure the two trim pieces together. A plurality of interwoven first strands form a first cover material and a plurality of interwoven second strands form a second cover material. The first stitching material loops around the interwoven first strands to pull the first cover material against the first seam and cover the apertures in the trim piece. The second stitching material loops around the interwoven second strands to pull the second cover material against the second seam and cover the apertures in the other trim piece. Hence, any apertures or cavities along either seam created by the sewing process are covered.

47 Claims, 4 Drawing Sheets

METHOD AND APPARATUS FOR SEWING A PLURALITY OF TRIM PIECES TOGETHER

TECHNICAL FIELD

The subject invention relates to a method and apparatus for sewing a multitude of trim pieces together to form an automotive seat assembly. More specifically, the subject invention relates to a new and improved means for sealing any seams created by the sewing process, thereby preventing any leakage of injected liquid foam through the seams.

BACKGROUND OF THE INVENTION

The manufacturing of an automotive seat assembly may incorporate any number of different processes. For example, foam cushions for seat bottoms and seat backs may be glued or steam heated to a respective trim cover material. The trim covers may be pre-sewn and may or may not include trim strips, as are well known in the art. Foam cushions for side bolsters may also be glued or steam heated to a trim cover material. Further, pre-sewn side bolsters and/or pre-sewn headrests may be injected with a liquid foam. Foam injection processes are well known in the art and include a number of different manufacturing techniques.

A typical foam injection technique first includes pre-sewing the intended seating component, i.e., a headrest. The pre-sewn trim cover material must be protected against the injected liquid foam. Typically, a thin foam sheet with a plastic liner is adhered to the inside surface of the trim cover. The foam sheet provides for extra cushion and the plastic liner protects the foam sheet from the injected liquid foam. The plastic liner prevents any absorption of the liquid foam by the foam sheet. The pre-sewn trim cover typically forms a type of envelope with an opening therein. The envelope is then placed within a cast wherein the interior of the cast incorporates the desired shape of the seating component. The liquid foam is injected within the trim cover envelope and allowed to cure and harden to form the final padded product. A major difficulty in this foam injection process is ensuring that no liquid foam leaks through the seams in the pre-sewn trim cover envelope. If leakage does occur, the product is aesthetically displeasing and unmarketable.

The current method of sealing the seams is to sew additional strips of foam over the seams. The additional foam strips are known in the art as scam seal tape. Seam seal tape attempts to stop leakage by absorbing a portion of the injected liquid foam. The absorption occurs because the foam strips do not have any plastic liner adhered thereto. This method of sealing seams in a pre-sewn trim cover envelope, however, has a number of deficiencies. First, the foam strips are relatively expensive and difficult to use. The flexibility of the foam strips can cause a number of problems during the sewing process. For example, the foam strips can be difficult to guide and align with the seams. Further, if the foam strips are stretched excessively or torn then leakage through the seams may occur. Additionally, the foam strips harden from the absorption of the liquid foam, which creates a hard undesirable seam.

SUMMARY OF THE INVENTION AND ADVANTAGES

An automotive seat assembly comprising a first trim piece having a top surface and a bottom surface and a second trim piece having a top surface and a bottom surface. The first trim piece has an edge portion overlaying an edge portion of the second trim piece along the respective top surfaces. Each of the first and second trim pieces include a plurality of spaced apart apertures extending through the respective top and bottom surfaces along the edge portions. A continuous first stitching material passes through and between each of the apertures along the bottom surface of the first trim piece to form a first seam. A continuous second stitching material passes through and between each of the apertures along the bottom surface of the second trim piece to form a second seam. The first stitching material loops around the second stitching material between the bottom surfaces of the first and second trim pieces.

A plurality of interwoven first strands form a first cover material and a plurality of interwoven second strands form a second cover material. The first stitching material loops around at least a portion of the interwoven first strands to pull the first cover material against the first seam and cover the apertures in the first trim piece. The second stitching material loops around at least a portion of the interwoven second strands to pull the second cover material against the second seam and cover the apertures in the second trim piece.

Accordingly, the subject invention adequately covers and seals any seams within a seating component created during a sewing process. Hence, when liquid foam is injected into the seating component, the liquid foam will not leak through the seams.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
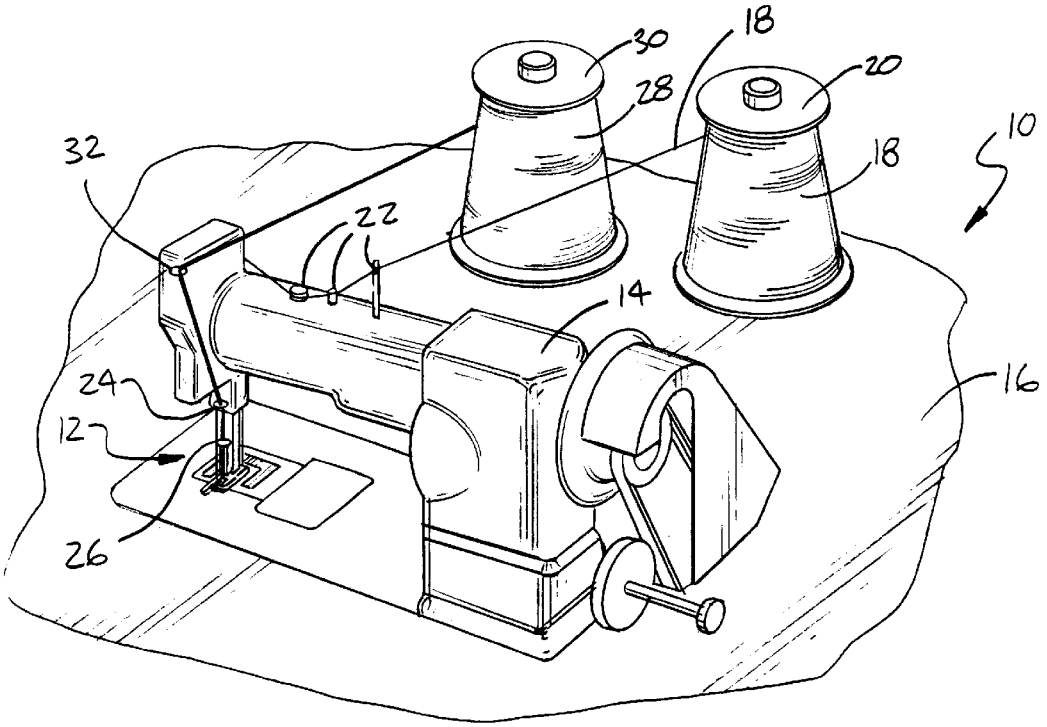
FIG. 1 is a perspective view of a sewing machine assembly incorporating the subject invention.

Referring to the FIGS., wherein like numerals indicate like or corresponding parts throughout the several views, a sewing machine assembly is generally shown at 10 in FIG. 1. The sewing machine assembly 10 includes a stitching component, generally shown at 12, and a belt driven motor assembly 14. The motor assembly 14 is supported by a table 16. A continuous first stitching material 18 is drawn from a thread spool 20 into a number of thread guides 22 located on the motor assembly 14. The first stitching material 18 then passes through a juncture guide 24 and a needle bar guide 26. The first stitching material 18 is nylon thread, which is commercially available from American Efirt. However, any suitable material, such as cotton thread, with adequate strength characteristics could be used without deviating from the scope of the subject invention. A first cover material 28 is drawn from a first yarn spool 30 into a yarn guide 32 located on the motor assembly 14. The first cover material 28 then passes through the juncture guide 24 and the needle bar guide 26. The first cover material 28 is a tightly woven acrylic yarn. However, other suitable materials, such as cotton yarn, could be utilized without deviating from the scope of the subject invention. As appreciated by those skilled in the art, numerous additional components necessary to the proper operation of the sewing machine assembly 10 are not disclosed. These additional components are not positively set forth in the appending claims and do not form any part of the inventive components of the subject invention.

Figure 2:
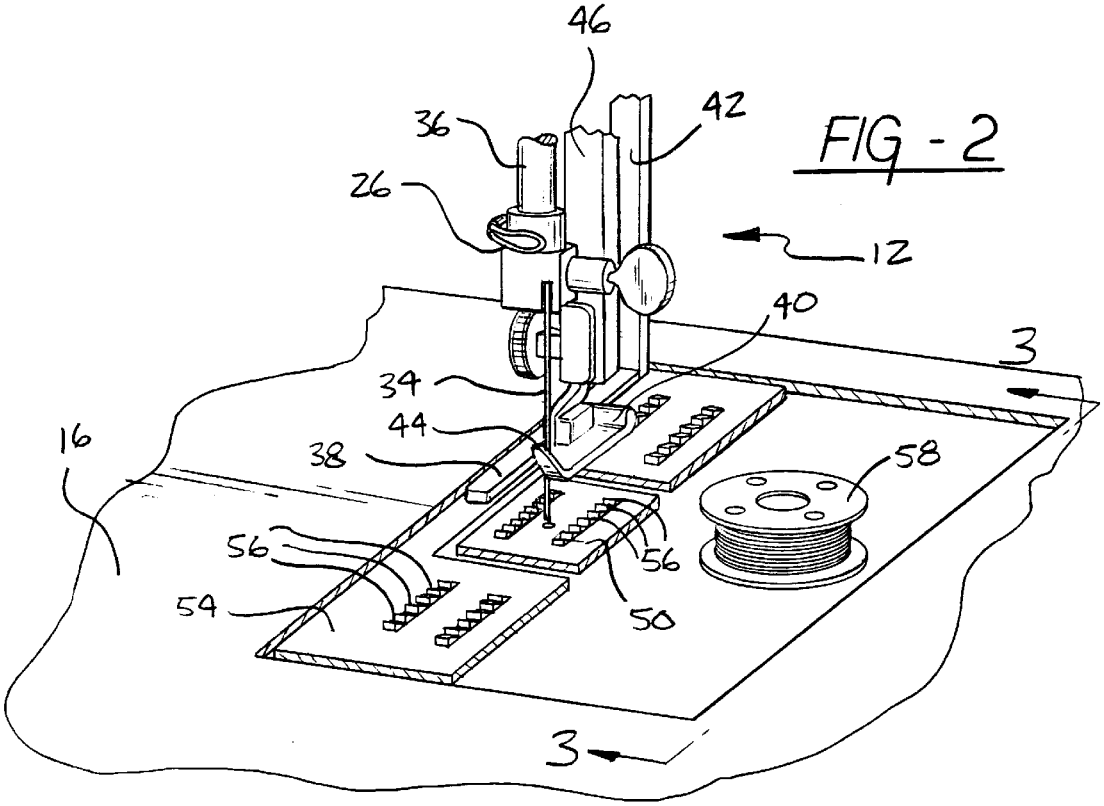
FIG. 2 is an exploded view of a stitching component of the sewing machine assembly of FIG. 1.

Referring to FIG. 2, the stitching component 12 of the sewing machine assembly 10 is shown in greater detail. The stitching component 12 comprises a needle 34 mounted to a moveable needle bar 36. The needle bar guide 26 is also attached to the needle bar 36. A presser foot 38 and a vibrator foot 40 are mounted near the needle bar 36. The presser foot 38 comprises an L-shaped member 38 mounted to a moveable shaft 42 wherein the L-shaped member 38 is disposed outside the needle 34. The vibrator foot 40 comprises an L-shaped member 40 having an upwardly bent end 44. The L-shaped member 40 of the vibrator foot 40 is mounted to a moveable shaft 46 and is disposed inside the needle 34. A through hole 48 is located within the L-shaped member 40 of the vibrator foot 40 to allow the needle 34 to pass therethrough. This type of sewing machine assembly is known in the art as a walking foot sewing machine. As appreciated by those skilled in the art, the presser foot and/or vibrator foot may be of any suitable design or configuration without deviating from the scope of the subject invention.

A moveable feed dog 50 is located directly below the needle 34, presser foot 38 and vibrator foot 40. The feed dog 50 also has a through hole 52 to allow the needle 34 to pass therethrough. A stationary plate 54 is mounted in close proximity to the feed dog 50. Both the feed dog 50 and stationary plate 54 are mounted within the table 16 of the sewing machine assembly 10. A plurality of gripping members 56 are formed within the feed dog 50 and the stationary plate 54. A bobbin 58 is rotatably mounted below the table 16 and near the feed dog 50.

Figure 3:
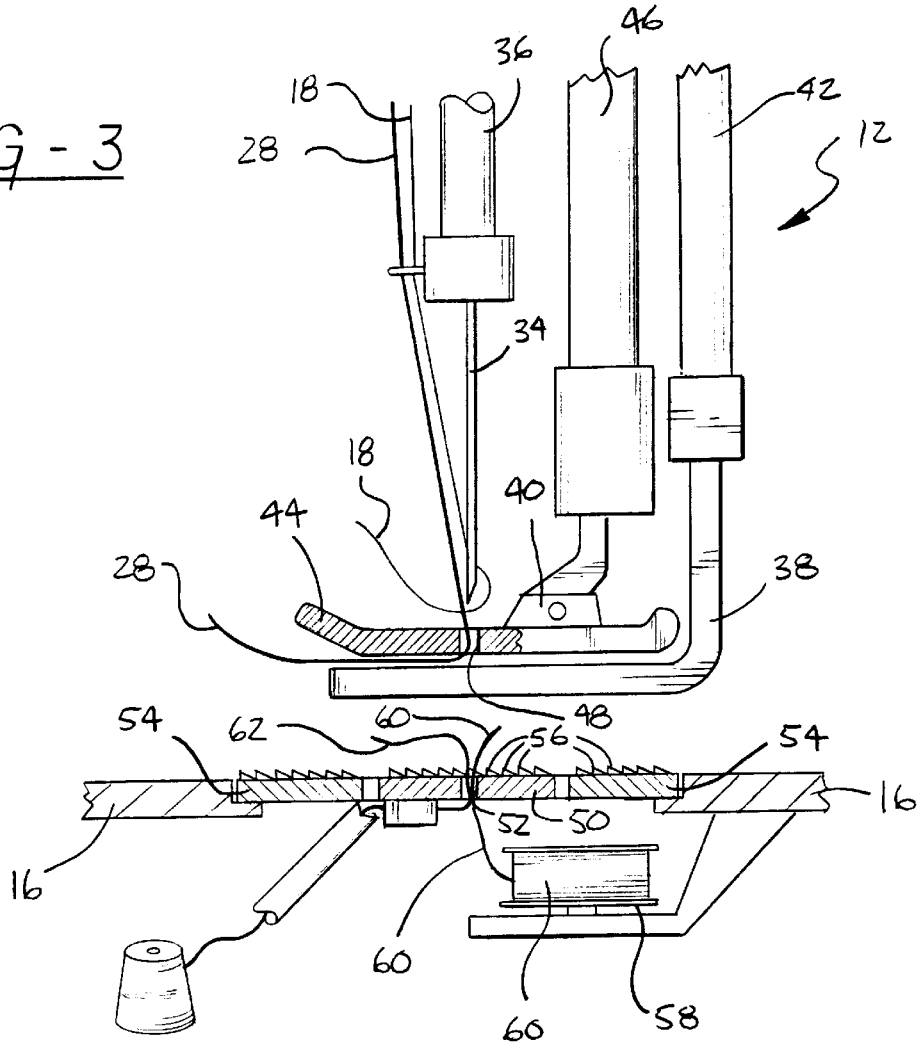
FIG. 3 is a partially cross-sectional side view taken along line 3—3 of FIG. 2.
Figure 4:
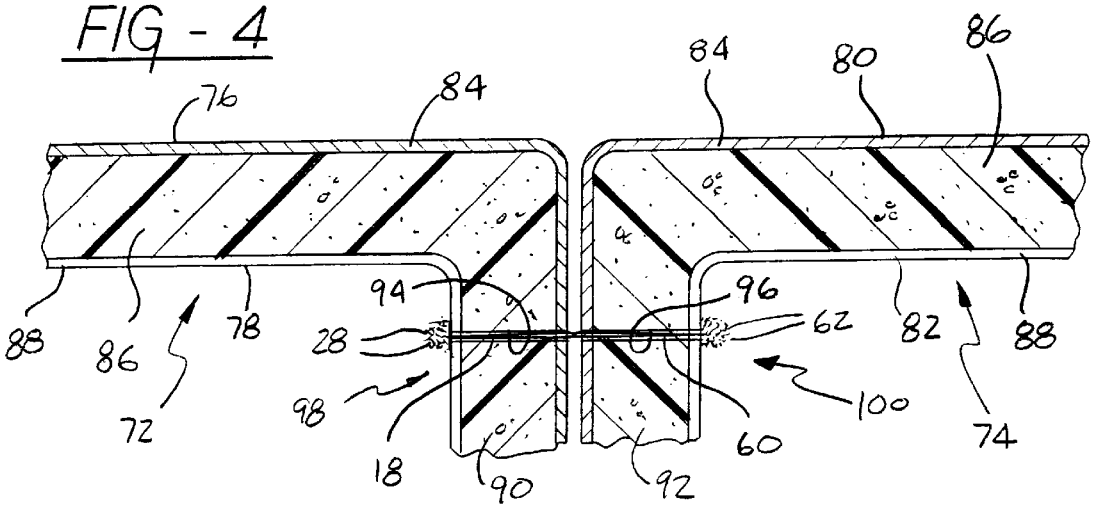
FIG. 4 is a cross-sectional end view of sewn trim pieces incorporating the subject invention.
Figure 5:
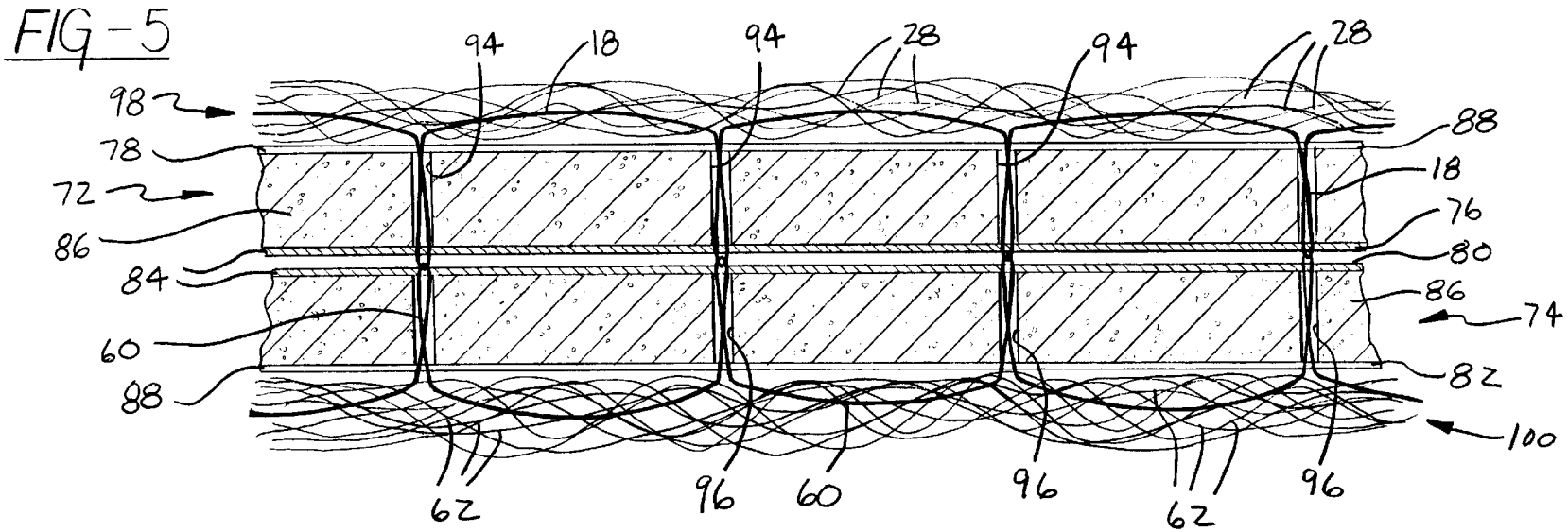
FIG. 5 is a cross-sectional side view of sewn trim pieces incorporating the subject invention.

Referring also to FIGS. 3, 4, and 5, the first stitching material 18 is shown passing through the needle bar guide 26 and the needle 34. The first cover material 28 passes through the needle bar guide 26 and then through the hole 48 in the vibrator foot 40. A continuous second stitching material 60 is wound around the bobbin 58 and passes upwardly through the hole 52 in the feed dog 50. The second stitching material 60 is nylon thread and is substantially the same as the first stitching material 18. However, as appreciated by those skilled in the art, the second stitching material 60 may be any suitable material, such as cotton thread. A second cover material 62 is provided from a second yarn spool 64 and is also fed through the hole 52 in the feed dog 50. The second cover material 62 is acrylic yarn and is substantially the same as the first cover material 28. Note, the second cover material 62 may be any suitable material without deviating from the scope of the subject invention. Guide members, generally shown at 66, guide the second cover material 62 from the second yarn spool 64 through the hole 52 in the feed dog 50.

The guide members 66 include a first guide 68 mounted to the feed dog 50 for guiding the second cover material 62 through the feed dog 50. The guide members 66 also include a second guide 70 mounted to the stationary plate 54 for guiding the second cover material 62 into the first guide 68 of the feed dog 50. The first 68 and second 70 guides are hollow tubes of sufficient diameters to allow the second cover material 62 to pass therethrough.

Although not shown in FIGS. 1, 2, or 3, first and second trim pieces, generally shown at 72 and 74 respectively, pass between the stitching component 12 and the feed dog 50 and stationary plate 54. The needle 34 pierces the first 72 and second 74 trim pieces to form a seam and sew the first 72 and second 74 trim pieces together.

During operation, the first 72 and second 74 trim pieces are fed between the presser 38 and vibrator 40 feet and the feed dog 50 and stationary plate 54. The needle 34, which is carrying the first stitching material 18, is lowered and passes through the vibrator foot 40, the first trim piece 72, the second trim piece 74, and the feed dog 50. During the engagement of the needle 34 with the trim pieces 72, 74, the vibrator foot 40 presses against the first trim piece 72 to hold the first 72 and second 74 trim pieces in place. Specifically, the needle 34 passes through the first cover material 28 as the needle 34 passes through the vibrator foot 40 and the needle 34 passes through the second cover material 62 as the needle 34 passes through the feed dog 50. The second stitching material 60 is then looped around the fist stitching material 18. The needle 34, along with the first 18 and second 60 stitching materials, retracts through the second trim piece 74. The needle 34 then continues to retract through the first trim piece 72. The first 18 and second 60 stitching materials are pulled by a tensioning component (not shown) on the sewing machine assembly 10. The first 72 and second 74 trim pieces are advanced along a longitudinal path and the needle 34 begins to lower again to repeat the above described operation. The feed dog 50 assists in the advancement of the trim pieces 72, 74 by moving upwardly and longitudinally. The gripping members 56 engage the second trim piece 74 to move the first 72 and second 74 trim pieces as described. During this continuously synchronous movement of the needle 34, the feed dog 50, and the first 72 and second 74 trim pieces, the first 18 and second 60 stitching materials are continuously fed from the thread spool 20 and bobbin 58, respectively. Simultaneously, the first cover material 28 is continuously fed from the first yarn spool 30 and the second cover material 62 is continuously fed from the second yarn spool 64 through the guide members 66. The specific components of the seams and trim pieces and the method of manufacture is described in greater detail hereinbelow with specific reference to FIGS. 3, 4, and 5.

FIGS. 4 and 5 are exaggerated views of the first 72 and second 74 trim pieces sewn together. The spaces between the first 72 and second 74 trim pieces are provided simply for illustrative purposes. In actuality the first 72 and second 74 trim pieces are sewn tightly together.

The first trim piece 72 has a top surface 76 and a bottom surface 78 and the second trim piece 74 also has a top surface 80 and a bottom surface 82. The top surfaces 76, 80 of the first 72 and second 74 trim pieces include trim cover materials 84 with thin foam sheets 86 adhered thereto. The bottom surfaces 78, 82 of the first 72 and second 74 trim pieces include plastic liners 88 that are adhered to the thin foam sheets 86. As discussed in the background section, the foam sheets 86 protect and cushion the trim cover materials 84 and the plastic liners 88 protect the foam sheets 86. As appreciated by those skilled in the art, the first 72 and second 74 trim pieces may be of any suitable design or configuration without deviating from the scope of the subject invention.

Both the first 72 and second 74 trim pieces have an edge portion 90, 92 wherein the edge portion 90 of the first trim piece 72 overlays the edge portion 92 of the second trim piece 74 along the respective top surfaces 76, 80. In other words, the trim cover materials 84 of the first 72 and second 74 trim pieces abut each other at their respective edge portions 90, 92. The first 72 and second 74 trim pieces also include a plurality of spaced apart apertures 94, 96 extending through the respective top 76, 80 and bottom 78, 82 surfaces along the edge portions 90, 92. More specifically, the apertures 94 within the first trim piece 72 pass through the plastic liner 88, the foam sheet 86, and the trim cover material 84 of the first trim piece 72. Similarly, the apertures 96 within the second trim piece 74 pass through the plastic liner 88, foam sheet 86, and the trim cover material 84 of the second trim piece 74. The apertures 94, 96 are created by the piercing of the needle 34 through the respective trim pieces 72, 74. Again for illustrative purposes, the apertures 94, 96 in the first 72 and second 74 trim pieces are shown as large cavities. In actual practice the apertures 94, 96 are relatively small cavities just slightly larger than the first 72 and second 74 stitching materials that pass therethrough.

The continuous first stitching material 18 passes through and between each of the apertures 94 along the bottom surface 78 of the first trim piece 72 to form a first seam, generally shown at 98. More specifically, the first stitching material 18 passes into the aperture 94, out of the aperture 94, and then abuts at least a portion of the plastic liner 88 of the bottom surface 78 of the first trim piece 72 between the spaced apart apertures 94 in the first trim piece 72. Similarly, the continuous second stitching material 60 passes through and between each of the apertures 96 along the bottom surface 82 of the second trim piece 74 to form a second seam, generally shown at 100. More specifically, the second stitching material 60 passes into the aperture 96, out of the aperture 96, and then abuts at least a portion of the plastic liner 88 of the bottom surface 82 of the second trim piece 74 between the spaced apart apertures 96 in the second trim piece 74.

The second stitching material 18 loops around the first stitching material 60 between the bottom surfaces 78, 82 of the first 72 and second 74 trim pieces. More specifically, the first stitching material 18 loops around the second stitching material 60 between the trim cover materials 84 of the top surfaces 76, 82 of the first 72 and second 74 trim pieces.

A plurality of interwoven first strands 28 form the first cover material 28 and a plurality of interwoven second strands 62 form the second cover material 62. The first stitching material 18 loops around at least a portion of the interwoven first strands 28 to pull the first cover material 28 against the first seam 98 and cover the apertures 94 in the first trim piece 72. Specifically, the first stitching material 18 loops around the first strands 28 between the apertures 94 in the first trim piece 72. Similarly, the second stitching material 60 loops around at least a portion of the interwoven second strands 62 to pull the second cover material 62 against the second seam 100 and cover the apertures 96 in the second trim piece 74. Specifically, the second stitching material 60 loops around the second strands 62 between the apertures 96 in the second trim piece 74. For illustrative purposes, the first 18 and second 60 stitching materials are shown spaced apart from the bottom surfaces 78, 82 of the first 72 and second 74 trim pieces to easily illustrate that the first 28 and second 62 strands pass over and under the first 18 and second 60 stitching materials. The first 28 and second 62 cover materials do not extend into the apertures 94, 96 within the respective first 72 and second 74 trim pieces. The method of manufacturing the subject invention is discussed hereinbelow.

The method of securing the first 72 and second 74 trim pieces together utilizes the continuous first 18 and second 60 stitching materials that form the first 98 and second 1 00 seams, respectfully. The plurality of interwoven first 28 and second 62 strands define the first 28 and second 62 cover materials, respectively, for covering each of the seams 98, 100. The method comprises the steps of; feeding the continuous first stitching material 18 through and between each of the plurality of apertures 94 in the first trim piece 72 along the first seam 98; feeding the continuous second stitching material 60 through and between each of the plurality of apertures 96 in the second trim piece 74 along the second seam 100; looping the first stitching material 18 around the second stitching material 60 between the first 72 and second 74 trim pieces; looping the first stitching material 18 around at least a portion of the interwoven first strands 28 between each of the apertures 94 along the first seam 98 of the first trim piece 72; looping the second stitching material 60 around at least a portion of the interwoven second strands 62 between each of the apertures 96 along the second seam 100 of the second trim piece 74; pulling the first cover material 28 against the first seam 98 to cover the apertures 94 in the first trim piece 72; and pulling the second cover material 62 against the second seam 100 to cover the apertures 96 in the second trim piece 74.

The method of forming the first seam 98 is further defined by passing the first stitching material 18 through the apertures 94 in the first trim piece 72 and overlaying the first stitching material 18 along the first trim piece 72 between the apertures 94. Similarly, the method of forming the second seam 100 is further defined by passing the second stitching material 60 through the apertures 96 in the second trim piece 74 and overlaying the second stitching material 60 along the second trim piece 74 between the apertures 96.

The looping of the first 18 and second 60 stitching materials is further defined by passing the first stitching material 18 through both the first 72 and second 74 trim pieces, looping the second stitching material 60 around the first stitching material 18 and retracting the first 18 and second 60 stitching materials through the second trim piece 74 to position the intertwined loops of the first 18 and second 60 stitching materials between the first 72 and second 74 trim pieces.

As discussed above in relationship to the needle 34 of the sewing machine assembly, the looping of the first stitching material 18 around at least a portion of the interwoven first strands 28 is further defined by passing the first stitching material 18 through the first cover material 28 before the first stitching material 18 passes through the first trim piece 72. Similarly, the looping of the second stitching material 60 around at least a portion of the interwoven second strands 62 is further defined by passing the second stitching material 60 through the second cover material 62 before the second stitching material 60 passes through the second trim piece 74.

The primary embodiment of the subject invention has been discussed above with particular reference to FIGS. 3, 4, and 5. This primary embodiment provides an efficient means for covering apertures in pre-sewn trim pieces. An alternative embodiment of the subject invention is disclosed hereinbelow wherein like numerals increased by one hundred indicate like or corresponding parts.

Figure 6:
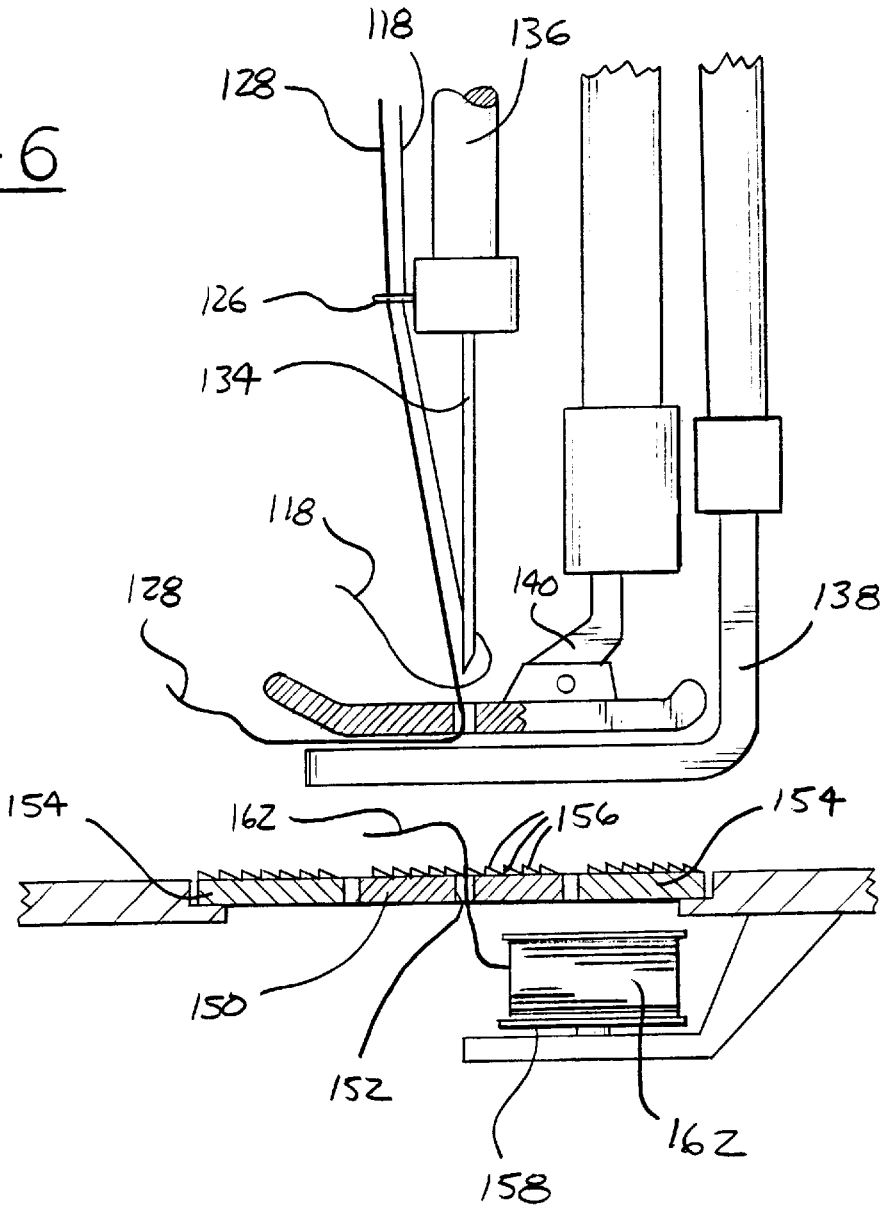
FIG. 6 is a partially cross-sectional side view of an alternative embodiment of the subject invention.

The alternative embodiment of the subject invention has a number of similarities to the primary embodiment. Referring to FIG. 6, the stitching component 112 of the sewing machine assembly 110 is substantially the same as the primary embodiment. Specifically, the needle 134 mounted to the moveable needle bar 136, the needle bar guide 126, the presser foot 138, the vibrator foot 140, the feed dog 150, and the stationary plate 154 are all substantially the same. However, the guide members and second yarn spool of the primary embodiment are eliminated from the alternative embodiment. A continuous first stitching material 118 and a first cover material 128 are included and are substantially the same as the first stitching material 18 and the first cover material 28 of the primary embodiment. A second cover material 162 is wound around the bobbin 158 and is fed through a hole 152 in the feed dog 150. A second stitching material as disclosed in the primary embodiment is eliminated in the alternative embodiment. As in the primary embodiment the first 128 and second 162 cover materials are acrylic yarn and the first stitching material 118 is a nylon thread.

The operation of the alternative embodiment is also similar to the operation of the primary embodiment. The key difference is the elimination of the second stitching material.

During operation, first 172 and second 174 trim pieces are fed between the presser 138 and vibrator 140 feet and the feed dog 150 and stationary plate 154. The needle 134, which is carrying the first stitching material 118, is lowered and passes through the vibrator foot 140, the first trim piece 172, the second trim piece 174, and the feed dog 150. During the engagement of the needle 134 with the trim pieces 172, 174, the vibrator foot 140 presses against the first trim piece 172 to hold the first 172 and second 174 trim pieces in place. Specifically, the needle 134 passes through the first cover material 128 as the needle 134 passes through the vibrator foot 140. The second cover material 162 is then looped around the fist stitching material 118. The needle 134 then retracts through the first 172 and second 174 trim pieces. The first stitching material 118 and second cover material 162 are pulled by a tensioning component (not shown) on the sewing machine assembly 10. The first 172 and second 174 trim pieces are then advanced along a longitudinal path and the needle 134 begins to lower again to repeat the above described operation. The feed dog 150 assists in the advancement of the trim pieces 172, 174 by moving upwardly and longitudinally. Gripping members 156 on the feed dog 150 engage the second trim piece 174 to move the first 172 and second 174 trim pieces as described. During this continuously synchronous movement of the needle 134, the feed dog 150, and the first 172 and second 174 trim pieces, the first stitching material 118 is continuously fed from a thread spool (not shown). Simultaneously, the first cover material 128 is continuously fed from a yarn spool (not shown) and the second cover material 162 is continuously fed from the bobbin 158. The specific components of the seams and trim pieces and the method of manufacture of the alternative embodiment is discussed in greater detail herein below.

Figure 7:
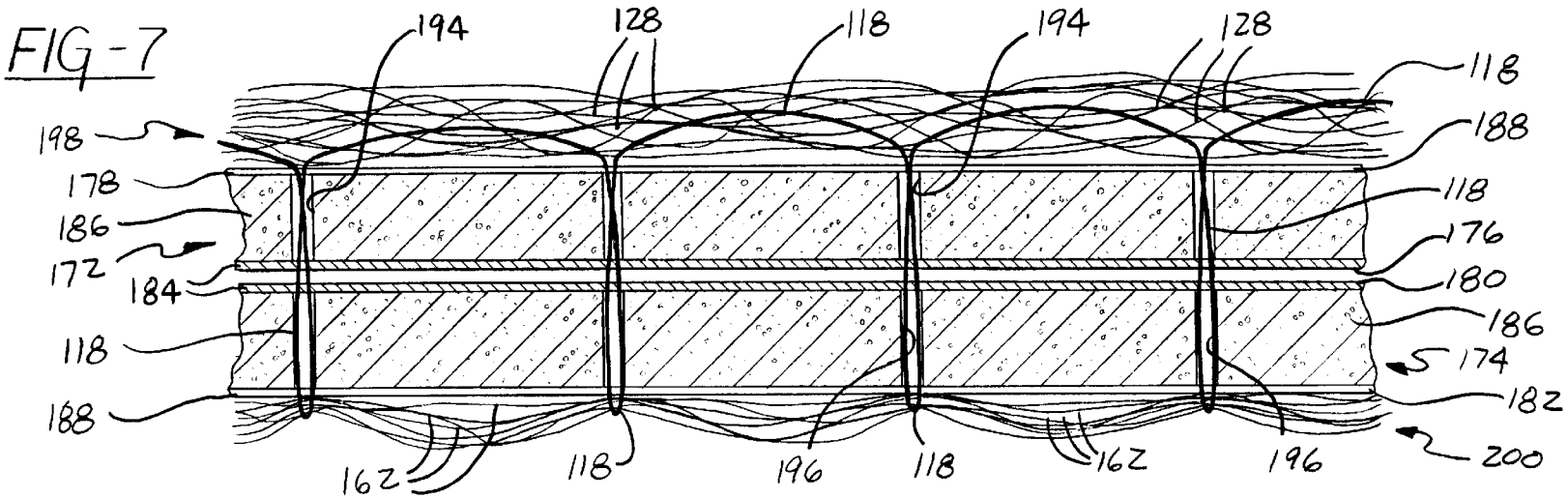
FIG. 7 is a cross-sectional side view of sewn trim pieces incorporating the alternative embodiment of the subject invention.

Referring also to FIG. 7, the first trim piece 172 has a top surface 176 and a bottom surface 178 and the second trim piece 174 also has a top surface 180 and a bottom surface 182. The bottom surfaces 178, 182 of the first 172 and second 174 trim pieces include trim cover materials 184 with thin foam sheets 186 adhered thereto. The foam sheets 186 of the first 172 and second 174 trim pieces are covered by plastic liners 188.

Both the first 172 and second 174 trim pieces have an edge portion (not shown) wherein the edge portion of the first trim piece 172 overlays an edge portion of the second trim piece 174 along the respective top surfaces 176, 180. The first 172 and second 174 trim pieces also include a plurality of spaced apart apertures 194, 196 extending through their respective top 176, 180 and bottom 178, 182 surfaces along the edge portions. As in the primary embodiment, the apertures 194, 196 are created by the piercing of the needle 134 through the respective trim pieces 172, 174.

The continuous first stitching material 118 passes through and between each of the apertures 194 along the bottom surface 178 of the first trim piece 172 to form a first seam 198. More specifically, the first stitching material 118 passes into the aperture 194, out of the aperture 194, and then abuts at least a portion of the plastic liner 188 of the bottom surface 178 of the first trim piece 172 between the spaced apart apertures 194 in the first trim piece 172. A plurality of interwoven first strands 128 form the first cover material 128. The first stitching material 118 loops around at least a portion of the interwoven first strands 128 to pull the first cover material 128 against the first seam 198 and cover the apertures 194 in the first trim piece 172. Specifically, the first stitching material 118 loops around the first strands 128 between the apertures 194 in the first trim piece 172. Hence, the first seam 198, having the first stitching material 118 overlaying a portion of the first cover material 128 and first trim piece 172, is substantially the same as in the primary embodiment.

A plurality of interwoven second strands 162 form the second cover material 162. The second cover material 162 is substantially thicker than a typical stitching material. The first stitching material 118 loops around the second cover material 162 to pull the second cover material 162 against the bottom surface 182 of the second trim piece 174 to form a second seam 200 and cover the spaced apart apertures 196 in the second trim piece 174. More specifically, the first stitching material 118 passes through the apertures 194, 196 in both the first 172 and second 174 trim pieces and loops around the second cover material 162 at the opening of the apertures 196 in the second trim piece 174. Accordingly, the second cover material 162 substantially covers the apertures 196 in the second trim piece 174. As discussed above, the second cover material 162 also extends along and abuts the bottom surface 182 of the second trim piece 174 between the apertures 196 in the second trim piece 174. The first 128 and second 162 cover materials do not extend into the apertures 194, 196 within the respective first 172 and second 174 trim pieces.

The method of manufacturing the alternative embodiment of the subject invention is now described in detail. The method of securing the first 172 and second 174 trim pieces together utilizes the continuous first stitching material 118 which forms the first seam 198. The plurality of interwoven first strands 128 defines the first cover material 128 for covering the first seam 198. The plurality of interwoven second strands 162 defines the second cover material 162 to form the second seam 200. The method comprises the steps of; feeding the continuous first stitching material 118 through and between each of a plurality of apertures 194 in the first trim piece 172 along the first seam 198; looping the first stitching material 118 around at least a portion of the interwoven first strands 128 between each of the apertures 194 along the first seam 198 of the first trim piece 172; pulling the first cover material 128 against the first seam 198 to cover the apertures 194 in the first trim piece 172; feeding the continuous first stitching material 118 through each of a plurality of apertures 196 in the second trim piece 174 along the second seam 200; looping the second cover material 162 around the first stitching material 118; and pulling the second cover material 162 against the second seam 200 to cover the apertures 196 in the second trim piece 174.

The method of forming the first seam 198 is further defined by passing the first stitching material 118 through the apertures in the first trim piece 172 and overlaying the first stitching material 118 along the first trim piece 172 between the apertures 194. The method of forming the second seam 200 is further defined by overlaying the second cover material 162 along the second trim piece 174 between the apertures 196 of the second trim piece 174.

The looping of the first stitching material 118 and the second cover material 162 is further defined by passing the first stitching material 118 through the apertures 194, 196 in both the first 172 and second 174 trim pieces and looping the second cover material 162 around the first stitching material 118.

The looping of the first stitching material 118 around at least a portion of the interwoven first strands 128 is further defined by passing the first stitching material 118 through the first cover material 128 before the first stitching material 118 passes through the first trim piece 172.

This alternative embodiment also provides an efficient means for covering apertures in pre-sewn trim pieces.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. An automotive seat assembly comprising, a first trim piece having a top surface and a bottom surface, a second trim piece having a top surface and a bottom surface, said first trim piece having an edge portion overlaying an edge portion of said second trim piece along said respective top surfaces, each of said first and second trim pieces including a plurality of spaced apart apertures extending through said respective top and bottom surfaces along said edge portions, a continuous first stitching material passing through and between each of said apertures along said bottom surface of said first trim piece to form a first seam, a continuous second stitching material passing through and between each of said apertures along said bottom surface of said second trim piece to form a second seam, said second stitching material looping around said first stitching material between said bottom surfaces of said first and second trim pieces, a plurality of interwoven first strands forming a first cover material, a plurality of interwoven second strands forming a second cover material, said first stitching material looping around at least a portion of said interwoven first strands to pull said first cover material against said first seam and cover said apertures in said first trim piece, and said second stitching material looping around at least a portion of said interwoven second strands to pull said second cover material against said second seam and cover said apertures in said second trim piece.

2. An assembly as set forth in claim 1 wherein said first stitching material abuts at least a portion of said bottom surface of said first trim piece between said apertures in said first trim piece.

3. An assembly as set forth in claim 2 wherein said first stitching material loops around said first strands between said apertures in said first trim piece.

4. An assembly as set forth in claim 1 wherein said second stitching material abuts at least a portion of said bottom surface of said second trim piece between said apertures in said second trim piece.

5. An assembly as set forth in claim 4 wherein said second stitching material loops around said second strands between said apertures in said second trim piece.

6. An assembly as set forth in claim 1 wherein said top surfaces of said first and second trim pieces include trim cover materials.

7. An assembly as set forth in claim 6 including thin foam sheets adhered to said trim cover materials of said first and second trim pieces.

8. An assembly as set forth in claim 7 wherein said bottom surfaces of said first and second trim pieces include plastic liners adhered to said foam sheets.

9. An assembly as set forth in claim 1 wherein said first and second stitching materials are nylon threads.

10. An assembly as set forth in claim 1 wherein said first and second cover materials are acrylic yarn.

11. An assembly as set forth in claim 1 wherein said first and second cover materials are cotton yarn.

12. A method of securing a first and second trim piece together utilizing continuous first and second stitching materials to form a first and second seam respectfully, and a plurality of interwoven first and second strands defining first and second cover materials, respectively, for covering each of the seams, the method comprising the steps of:

feeding the continuous first stitching material through and between each of a plurality of apertures in the first trim piece along the first seam, feeding the continuous second stitching material through and between each of a plurality of apertures in the second trim piece along the second seam, looping the first stitching material around the second stitching material between the first and second trim pieces, looping the first stitching material around at least a portion of the interwoven first strands between each of the apertures along the first seam of the first trim piece, looping the second stitching material around at least a portion of the interwoven second strands between each of the apertures along the second seam of the second trim piece, pulling the first cover material against the first seam to cover the apertures in the first trim piece, and pulling the second cover material against the second seam to cover the apertures in the second trim piece.

13. A method as set forth in claim 12 wherein the forming of the first seam is further defined by passing the first stitching material through the apertures in the first trim piece and overlaying the first stitching material along the first trim piece between the apertures.

14. A method as set forth in claim 12 wherein the forming of the second seam is further defined by passing the second stitching material through the apertures in the second trim piece and overlaying the second stitching material along the second trim piece between the apertures.

15. A method as set forth in claim 12 wherein the looping of the first and second stitching materials is further defined by passing the first stitching material through both the first and second trim pieces, looping the second stitching material around the first stitching material and retracting the first and second stitching materials through the second trim piece to position the intertwined loops of the first and second stitching materials between the first and second trim pieces.

16. A method as set forth in claim 15 wherein the looping of the first stitching material around at least a portion of the interwoven first strands is further defined by passing the first stitching material through the first cover material before the first stitching material passes through the first trim piece.

17. A method as set forth in claim 15 wherein the looping of the second stitching material around at least a portion of the interwoven second strands is further defined by passing the second stitching material through the second cover material before the second stitching material passes through the second trim piece.

18. A sewing machine assembly for sewing a plurality of trim pieces, said assembly comprising;

a needle, a first stitching material passing through said needle, a moveable vibrator foot, a first cover material passing through said vibrator foot, a moveable feed dog, a stationary plate mounted in close proximity to said feed dog, a second stitching material passing through said feed dog, a second cover material, and guide members for guiding said second cover material through said feed dog.

19. An assembly as set forth in claim 18 wherein said guide members include a first guide mounted to said feed dog for guiding said second cover material through said feed dog.

20. An assembly as set forth in claim 19 wherein said guide members include a second guide mounted to said stationary plate for guiding said second cover material into said first guide of said feed dog.

21. An assembly as set forth in claim 18 wherein said needle passes through said vibrator foot and said feed dog.

22. An assembly as set forth in claim 21 including a plurality of interwoven first and second strands forming said first and second cover materials respectively.

23. An assembly as set forth in claim 22 wherein said needle passes through said first cover material as said needle passes through said vibrator foot.

24. An assembly as set forth in claim 22 wherein said needle passes through said second cover material as said needle passes through said feed dog.

25. An assembly as set forth in claim 22 wherein said first and second cover materials are acrylic yarn.

26. An assembly as set forth in claim 22 wherein said first and second cover materials are cotton yarn.

27. An assembly as set forth in claim 18 wherein said first and second stitching materials are nylon threads.

28. An assembly as set forth in claim 18 including a plurality of yarn guides for guiding said first cover material to said vibrator foot.

29. An assembly as set forth in claim 28 including a plurality of thread guides for guiding said first stitching material to said needle.

30. An assembly as set forth in claim 29 including a bobbin for storing and dispensing said second stitching material through said feed dog.

31. An assembly as set forth in claim 30 including a plurality of gripping members on said feed dog for moving the trim pieces.

32. An automotive seat assembly comprising, a first trim piece having a top surface and a bottom surface, a second trim piece having a top surface and a bottom surface, said first trim piece having an edge portion overlaying an edge portion of said second trim piece along said respective top surfaces, each of said first and second trim pieces including a plurality of spaced apart apertures extending through said respective top and bottom surfaces along said edge portions, a continuous first stitching material passing through and between each of said apertures along said bottom surface of said first trim piece to form a first seam, a plurality of interwoven first strands forming a first cover material, said first stitching material looping around at least a portion of said interwoven first strands to pull said first cover material against said first seam and cover said apertures in said first trim piece, a plurality of interwoven second strands forming a second cover material, said second cover material looping around said first stitching material to pull said second cover material against said bottom surface of said second trim piece to form a second seam and cover said apertures in said second trim piece.

33. An assembly as set forth in claim 32 wherein said first stitching material abuts at least a portion of said bottom surface of said first trim piece between said apertures in said first trim piece.

34. An assembly as set forth in claim 33 wherein said first stitching material loops around said first strands between said apertures in said first trim piece.

35. An assembly as set forth in claim 32 wherein said first stitching material passes through each of said apertures of said first trim piece and each of said apertures of said second trim piece and loops around said second cover material at an opening of said apertures of said second trim piece.

36. An assembly as set forth in claim 35 wherein said second cover material abuts at least a portion of said bottom surface of said second trim piece between said apertures in said second trim piece.

37. An assembly as set forth in claim 32 wherein said top surfaces of said first and second trim pieces include trim cover materials.

38. An assembly as set forth in claim 37 including thin foam sheets adhered to said trim cover materials of said first and second trim pieces.

39. An assembly as set forth in claim 38 wherein said bottom surfaces of said first and second trim pieces include plastic liners adhered to said foam sheets.

40. An assembly as set forth in claim 32 wherein said first stitching material is nylon thread.

41. An assembly as set forth in claim 32 wherein said first and second cover materials are acrylic yarn.

42. An assembly as set forth in claim 32 wherein said first and second cover materials are cotton yarn.

43. A method of securing a first and second trim piece together utilizing a continuous first stitching material to form a first seam, a plurality of interwoven first strands defining a first cover material for covering the first seam and a plurality of interwoven second strands defining a second cover material to form a second seam, the method comprising the steps of:

feeding the continuous first stitching material through and between each of a plurality of apertures in the first trim piece along the first seam, looping the first stitching material around at least a portion of the interwoven first strands between each of the apertures along the first seam of the first trim piece, pulling the first cover material against the first seam to cover the apertures in the first trim piece, feeding the continuous first stitching material through each of a plurality of apertures in the second trim piece along the second seam, looping the second cover material around the first stitching material, and pulling the second cover material against the second seam to cover the apertures in the second trim piece.

44. A method as set forth in claim 43 wherein the forming of the first seam is further defined by passing the first stitching material through the apertures in the first trim piece and overlaying the first stitching material along the first trim piece between the apertures.

45. A method as set forth in claim 43 wherein the forming of the second seam is further defined by overlaying the second cover material along the second trim piece between the apertures.

46. A method as set forth in claim 43 wherein the looping of the second cover material and the first stitching material is further defined by passing the first stitching material through the apertures in both the first and second trim pieces and looping the second cover material around the first stitching material.

47. A method as set forth in claim 46 wherein the looping of the first stitching material around at least a portion of the interwoven first strands is further defined by passing the first stitching material through the first cover material before the first stitching material passes through the first trim piece.

* * * * *